United States Patent [19]

Hengl

[11] Patent Number: 4,711,229

[45] Date of Patent: Dec. 8, 1987

[54] MASSAGING APPARATUS FOR THE LOWER EXTREMITIES OF THE BODY

[76] Inventor: Gerhard G. Hengl, Jueptnergasse 17/1/14, A-1220 Vienna, Austria

[21] Appl. No.: 860,505

[22] Filed: May 7, 1986

[51] Int. Cl.[4] ..... A61H 7/00

[52] U.S. Cl. ..... 128/49; 128/52; 128/60; 128/44

[58] Field of Search ..... 128/33, 44–55, 128/57, 58, 60–62 R

[56] References Cited

U.S. PATENT DOCUMENTS

| | | | |
|---|---|---|---|
| 2,217,343 | 10/1940 | MacLevy | 128/49 |
| 2,266,859 | 12/1941 | Grampp | 128/60 |
| 2,874,689 | 2/1959 | Gavelek | 128/57 |
| 3,078;843 | 2/1963 | Brisson | 128/62 R |
| 3,880,150 | 4/1975 | Vileikis | 128/57 |

*Primary Examiner*—Edgar S. Burr
*Assistant Examiner*—Tonya Lamb
*Attorney, Agent, or Firm*—Young & Thompson

[57] ABSTRACT

A massaging machine promotes circulation in the lower extremities of the body of a user. It comprises massaging components formed as a pair of hollow semi-cylindrical concave dishes, which are driven by an electric motor in pivotal and oscillatory motion relative to a fixed base frame. A mounting plate is displaceable relative to the base frame and can be set in horizontal oscillations by way of a motor-driven single cam and return spring component moving along the longitudinal axis of the massaging components. An arcuate array of cylindrical bearings support each massage component, which in turn is rigidly attached to a lever arm protruding downwards. The lever arms are set in motion to carry out oscillations by way of a motor-driven double cam via rods and return springs. By way of this mechanical arrangement the massaging operation in two directions at once is achieved as in the case of manual massage. Specifically, the massaging is effected perpendicular to the axis of the legs in a radial and oscillating motion and longitudinal to the axis of the legs in a forward and backward motion.

5 Claims, 6 Drawing Figures

MASSAGING APPARATUS FOR THE LOWER EXTREMITIES OF THE BODY

BACKGROUND OF THE INVENTION

The invention consists of a massaging apparatus normally equipped with two massaging components adapted to massage the lower extremities (legs) of a person, wherein the massaging components are set in motion by a motor-driven propulsion unit based on a fixed frame to undertake rotational and reciprocal movements.

Massaging systems of a similar type are already known. However, these units primarily provide only shaking or vibrational movement. The disadvantage of these systems is that they are normally held by hand, or because of the position required of the user, are not always operated in a positive position relative to the body of the user.

SUMMARY OF THE INVENTION

The task to be undertaken therefore is to construct a massaging system of the type mentioned above, wherein the shape of the massaging components is rendered as harmonious as possible to the curved form of the lower extremities of the body of a user. Furthermore the massaging components are to be set in motion by a system of cams forming bi-directional medium frequency oscillations in a certain relationship to each other. Finally, these massage components should be arranged in such a way that the lower extremities of the body which is to be massaged is held in a completely relaxed and naturally prone position of the entire body. The invention therefore consists primarily of a basic frame with a top surface containing one set of cylindrically shaped bearings for each of the two massaging components. These massaging components consist of radially displaceable semi-cylindrical shapes, open at the top and supported underneath by a lever arm driven by way of an electric motor via a double cam transmitting an oscillating movement through a rod and spring system. At the same time the top surfaces, which form an integrated unit with the massage component support, are set in a horizontally oscillating motion by a motor-driven single cam and spring system, the horizontal motion being in the plane of the longitudinal axis of the hollow semi-cylindrical massage components. In this manner, a massaging is achieved corresponding to an individual muscle massage, promoting blood circulation of he lower extremities of the body.

BRIEF DESCRIPTION OF THE DRAWINGS

Further objects and advantages of the invention will become apparent from the following detailed description of a preferred embodiment, taken in conjunction with the accompanying drawings, wherein.

DETAILED DESCRIPTION OF THE INVENTION

Figure 1:
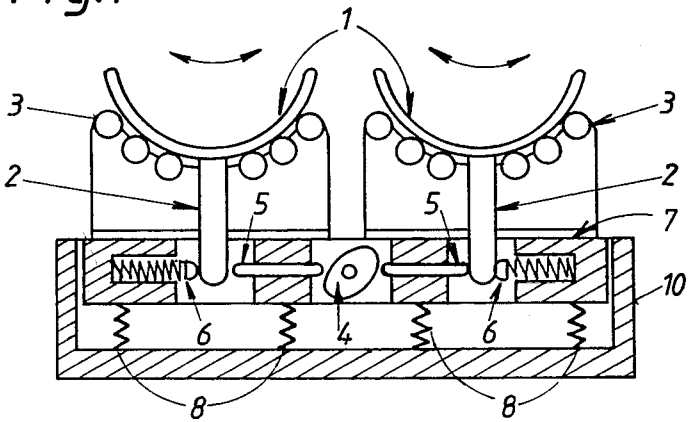
FIG. 1 is a vertical section through the apparatus according to the present invention.
Figure 2:
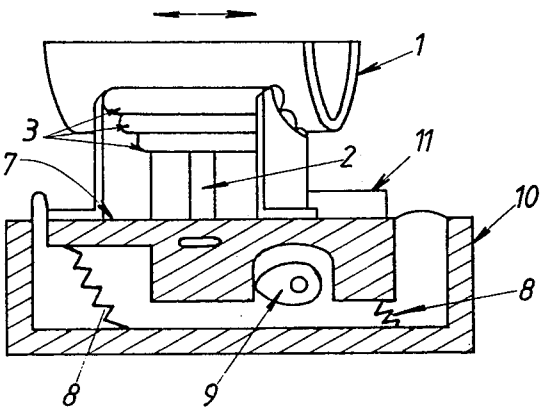
FIG. 2 is a sectional view taken along line A—A of FIG. 1.

Referring now to the drawings in detail, wherein like reference numerals indicate like elements throughout the several views and sections, the bearings 3, as can be seen in FIG. 1 and FIG. 2, are firmly connected to the unit that I describe as table 7 and together these form an integral unit. The lever arms 2 transmit horizontal oscillations generated by the double cam 4 via rods 5 and return springs 6. This lateral motion is converted into arc-like oscillations of the massaging components by way of the similarly arcuately arranged bearings 3. By way of the double cam arrangement 4 a compensating oscillation takes place which makes the table 7 almost free of vibration in one direction.

Figure 3:
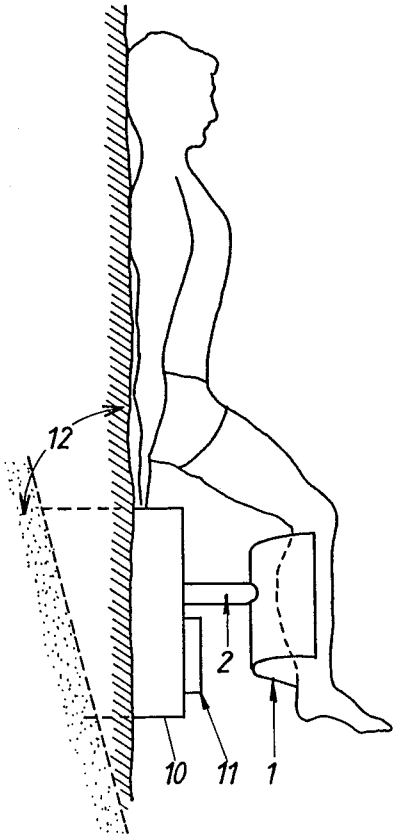
FIG. 3 is a side view of a user lying prone with his legs placed in the apparatus according to the invention.

Each of the two massaging components 1 (see FIGS. 1–3) forms a fixed and integral unit with its respective lever arm 2. The massaging components 1 and the lever arm 2 are guided by the bearings 3 (in the present case these bearings are of the roller type, however they could equally well be of the sleeve bearing type) in such a way as to induce an oscillation corresponding to the arc of the circle. The weight of the leg to be massaged (see FIGS. 3–5) acts as a force to increase the guiding effect of the corresponding component 1 in the bearings 3.

Table 7 (see FIGS. 1 and 2) is connected to the frame 10 by way of spring components 8, and, by way of a single cam 9 can be horizontally oscillated relative to the frame.

Figure 4:
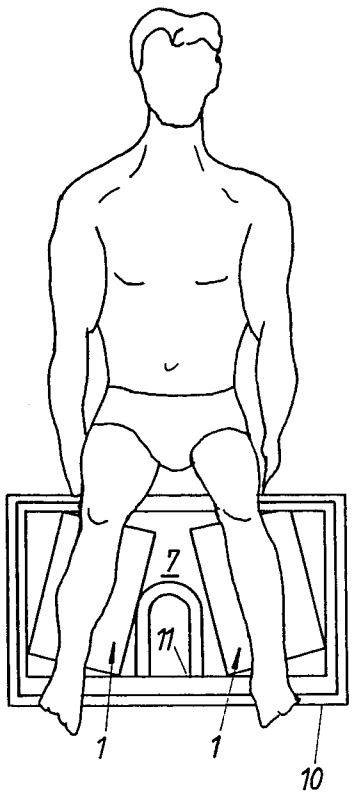
FIG. 4 is a plan view according to FIG. 3.
Figure 5:
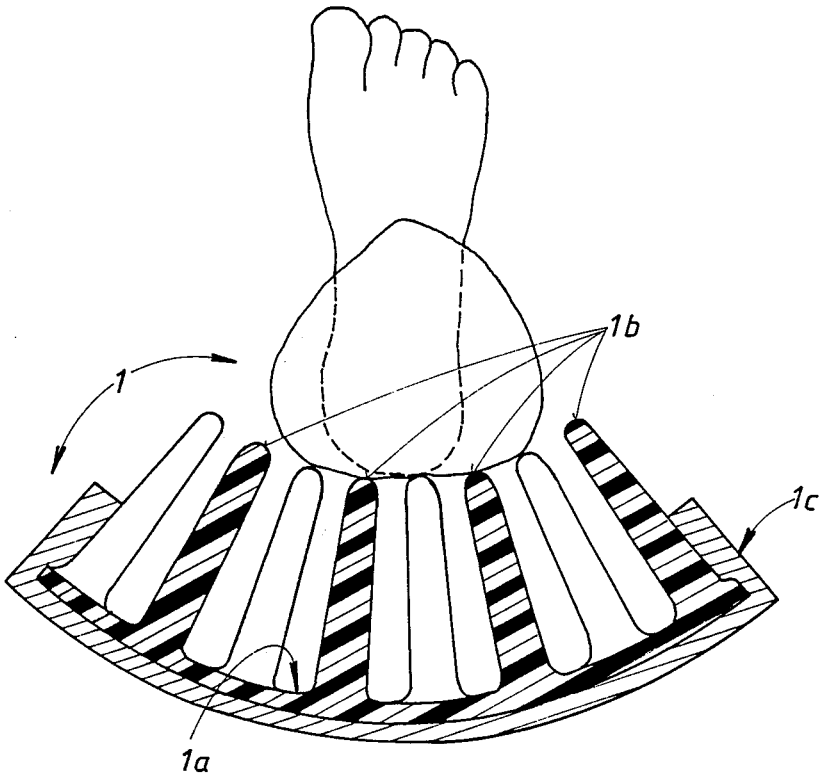
FIG. 5 is a vertical section through one of the massaging components according to the invention.
Figure 6:
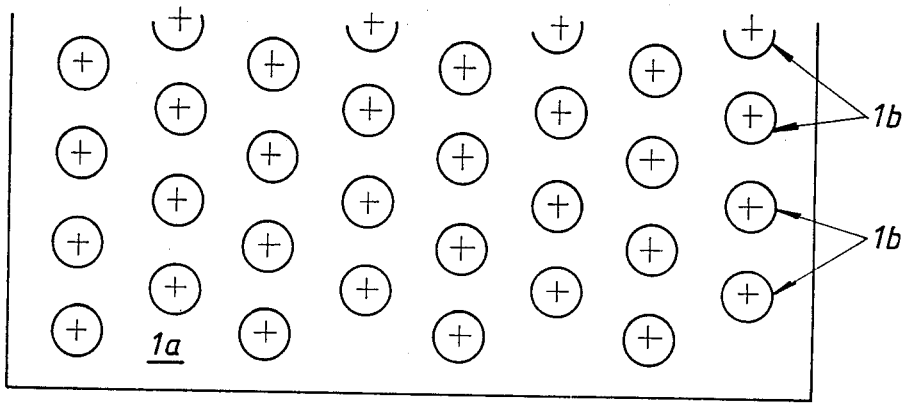
FIG. 6 is a plan view according to FIG. 5 of the individual massaging fingers 1*b*, with the finger matting 1*a* flattened into a planar configuration.

The table 7 can also be constructed in two sections to act as a dampener for the whole system with reference to the 180° arc of the cam 9. The cams 4 and 9 are driven as can be seen in FIGS. 2 and 4 wherein an electric motor with two gears is represented schematically at 11. This gives a controllable ratio to the bi-directional oscillations. The machine frame 10 should be set up on a supporting surface in such a way that it cannot slip or creep during operation.

The overall massaging component referred to as 1 in FIG. 1–FIG. 5 comprises a finger-shaped matting or pad referred to as 1*a*. This component, which should correspond to approximately the length of an average human leg, comprises slightly conical finger shapes 1*b* having rounded tops, manufactured of medium-hard flexible material in such a way that, when this finger matting 1*a* is adhesively secured to the concave shaped hollow cylindrical vessel 1*c*, the finger shaped cones 1*b* provide as dense a coverage as possible of those muscle areas to be massaged. The length of the individual fingers is determined by the degree of the flexibility of the material used.

Two massaging components 1 are provided, and as can be seen in FIG. 4, they are slightly divergent in order that the muscle section of the lower extremities to be massaged can be positioned in a natural and pleasant relationship to the body as a whole. By way of a mechanism now shown, the system can also be adjusted in height relative to the mounting location 12.

What is claimed is:

1. Apparatus for massaging the legs of a user, comprising a pair of arcuate massage components, each of said pair being formed as an axial section of an open-ended cylinder and having a concave surface adapted to receive a leg of a user and an oppositely disposed convex surface facing inwardly of said apparatus, a casing, a lever integrally mounted on said convex surface of each of said pair of massage components and having an end extending into said casing, first cam means adapted to act on said lever ends for displacing said levers along and opposite a first direction substantially perpendicular to the extent of said levers, motor means for driving said first cam means, and an arcuate array of cylindrical bearings individual to each of said pair of massage components and mounted on said casing, each said array of cylindrical bearings extending parallel to the axis of and contacting said convex surface of its corresponding massage component, whereby displacement of said levers along and opposite said first direction is translated into pivotal displacement of said pair of massage components about their respective axes.

2. Apparatus according to claim 1, wherein said casing comprises a mounting plate on which said arcuate arrays of cylindrical bearings are mounted, and second cam means adapted to act on said mounting plate for displacing said mounting plate along and opposite a second direction substantially perpendicular to said first direction.

3. Apparatus according to claim 2, wherein said first and second cam means comprise associated spring means for urging said levers and said mounting plate opposite said first and second directions, respectively.

4. Apparatus according to claim 2, wherein said mounting plate is divided in two sections, one section individual to each of said pair of massage components, said second cam means comprising a cam element individual to each of said two sections, each said cam element being limited to a range of movement of 180°, whereby said second cam means act as an oscillating damper for said mounting plate within said casing.

5. Apparatus according to claim 1, wherein each of said pair of massage components comprises a plurality of flexible finger elements extending from said concave surface, said finger elements having slightly conical projections with rounded tops.

* * * * *